US007516791B2

(12) United States Patent
Bryant et al.

(10) Patent No.: US 7,516,791 B2
(45) Date of Patent: Apr. 14, 2009

(54) CONFIGURABLE WELLBORE ZONE ISOLATION SYSTEM AND RELATED SYSTEMS

(75) Inventors: Rickey C. Bryant, Alvarado, TX (US); Jim L. Carr, Benbrook, TX (US); Timothy Edward LaGrange, Rainbow, TX (US); Kurt J. Schneidmiller, Burleson, TX (US); James M. Sloan, Burleson, TX (US); Troy D. Vass, Fort Worth, TX (US); Mitch W. Whitman, Covington, TX (US)

(73) Assignee: Owen Oil Tools, LP, Houston, TX (US)

( * ) Notice: Subject to any disclaimer, the term of this patent is extended or adjusted under 35 U.S.C. 154(b) by 23 days.

(21) Appl. No.: 11/753,411

(22) Filed: May 24, 2007

(65) Prior Publication Data

US 2008/0093079 A1 Apr. 24, 2008

Related U.S. Application Data

(60) Provisional application No. 60/808,757, filed on May 26, 2006.

(51) Int. Cl.
*E21B 33/124* (2006.01)

(52) U.S. Cl. ..... 166/277; 166/191; 166/206; 166/217; 166/382; 166/387

(58) Field of Classification Search ..... 166/206, 166/207, 380, 134, 191, 196, 387, 382, 277, 166/217
See application file for complete search history.

(56) References Cited

U.S. PATENT DOCUMENTS 886,114 A 4/1908 Collingwood
1,487,097 A 3/1924 Gallagher
1,804,619 A 5/1931 Humason
1,919,853 A 7/1933 Mack
2,345,873 A 4/1944 Hart
2,464,713 A 3/1949 Penick
2,715,444 A 8/1955 Fewel
3,282,346 A 11/1966 Claycomb
3,712,376 A 1/1973 Owen et al.
3,746,091 A 7/1973 Owen et al.
3,812,910 A 5/1974 Wellstein
3,948,321 A 4/1976 Owen et al.
4,628,997 A 12/1986 Schraub
4,753,444 A 6/1988 Jackson et al.
4,832,125 A 5/1989 Taylor
4,901,794 A 2/1990 Baugh et al.
5,251,695 A 10/1993 Coronado
5,271,468 A 12/1993 Streich et al.
5,293,945 A 3/1994 Rosenhauch et al.
5,456,327 A 10/1995 Denton et al.

(Continued)

*Primary Examiner*—Hoang Dang
(74) *Attorney, Agent, or Firm*—Madan Mossman & Sriram PC

(57) ABSTRACT

An apparatus for providing zonal isolation in a wellbore includes a plurality of interlocking sealing elements having anchor elements at the opposing ends. Each anchor element sealingly engages a wellbore tubular whereas the interlocking sealing elements do not engage any portion of wellbore therebetween. In one exemplary application utilizes a wellhead and lubricator positioned over a wellbore under pressure and a conveyance device for conveying equipment into the wellhead. The first anchor, the second anchor and the plurality of interlocking sealing elements are separately conveyed into the wellbore with the conveyance device and sequentially assembled in the wellbore to provide zonal isolation.

21 Claims, 6 Drawing Sheets

U.S. PATENT DOCUMENTS

| | | | |
|---|---|---|---|
| 6,276,690 | B1 | 8/2001 | Gazewood |
| 6,325,389 | B1 | 12/2001 | Sharify |
| 6,431,282 | B1 | 8/2002 | Bosma et al. |
| 6,834,725 | B2 | 12/2004 | Whanger et al. |
| 6,854,522 | B2 | 2/2005 | Brezinski et al. |
| 7,228,896 | B2 | 6/2007 | Gazewood |
| 2004/0256808 | A1 | 12/2004 | Tsuboi et al. |
| 2005/0173110 | A1 | 8/2005 | Traham |
| 2005/0183610 | A1 | 8/2005 | Barton et al. |
| 2006/0014269 | A1 | 1/2006 | Streit et al. |
| 2006/0032628 | A1 | 2/2006 | McGarian et al. |

CONFIGURABLE WELLBORE ZONE ISOLATION SYSTEM AND RELATED SYSTEMS

CROSS-REFERENCE TO RELATED APPLICATIONS

This application takes priority from U.S. Provisional Application Ser. No. 60/808,757 filed on May 26, 2006.

BACKGROUND OF THE DISCLOSURE

1. Field of the Disclosure

The present disclosure relates to devices and methods for isolating one or more selected zones in a wellbore to prevent fluid migration.

2. Description of the Related Art

In the oil and gas industry, a well is drilled to a subterranean hydrocarbon reservoir. A casing string is then run into the well and the casing string is cemented into place. The casing string can then be perforated and the well completed to the reservoir. A production string may be concentrically placed within the casing string and production of the hydrocarbons may begin, as is well understood by those of ordinary skill in the art.

During the drilling, completion, and production phase, operators find it necessary to perform various remedial work, repair and maintenance to the well, casing string, and production string. For instance, holes may be created in the tubular member accidentally or intentionally. Alternatively, operators may find it beneficial to isolate certain zones. Regardless of the specific application, it is necessary to place certain downhole assemblies such as a liner patch within the tubular member, and in turn, anchor and seal the down hole assemblies within the tubular member.

Numerous devices have been attempted to create a seal and anchor for these downhole assemblies. For instance, U.S. Pat. No. 3,948,321 entitled "LINER AND REINFORCING SWAGE FOR CONDUIT IN A WELLBORE AND METHOD AND APPARATUS FOR SETTING SAME" to Owen et al, discloses a method and apparatus for emplacing a liner in a conduit with the use of swage means and a setting tool. The Owen et al disclosure anchors and seals the liner within the wellbore.

While conventional wellbore sealing devices have generally been adequate, situations frequently arise wherein such conventional sealing devices cannot be efficiently deployed. For instance, surface equipment can limit the length of the seal device that can be conveyed into the well. In other instances, suitable conveyance devices are not available to efficiently handle and deploy conventional seal devices.

The present disclosure addresses these and other drawbacks of the prior art.

SUMMARY OF THE DISCLOSURE

In one aspect, the present disclosure provides an apparatus for providing zonal isolation in a wellbore that includes a plurality of interlocking sealing elements having anchor elements at the opposing ends. Each anchor element sealingly engages a wellbore tubular, such as a casing or liner. The interlocking sealing elements do not engage any portion of wellbore between the opposing ends.

In another aspect, the present disclosure provides a system for isolating a section of a wellbore having fluid under pressure. At the surface, the system, in one embodiment, includes a wellhead positioned over the wellbore, a lubricator positioned on the wellhead, and a conveyance device such as a wireline or drill tubing for conveying equipment into the lubricator and wellhead. In the wellbore, the system includes at least two axially spaced apart anchors adapted to sealingly engage a wellbore tubular and a plurality of interlocking sealing elements connecting the first anchor to the second anchor. The first anchor, the second anchor and the plurality of interlocking sealing elements can be separately conveyed into the wellbore with the conveyance device.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
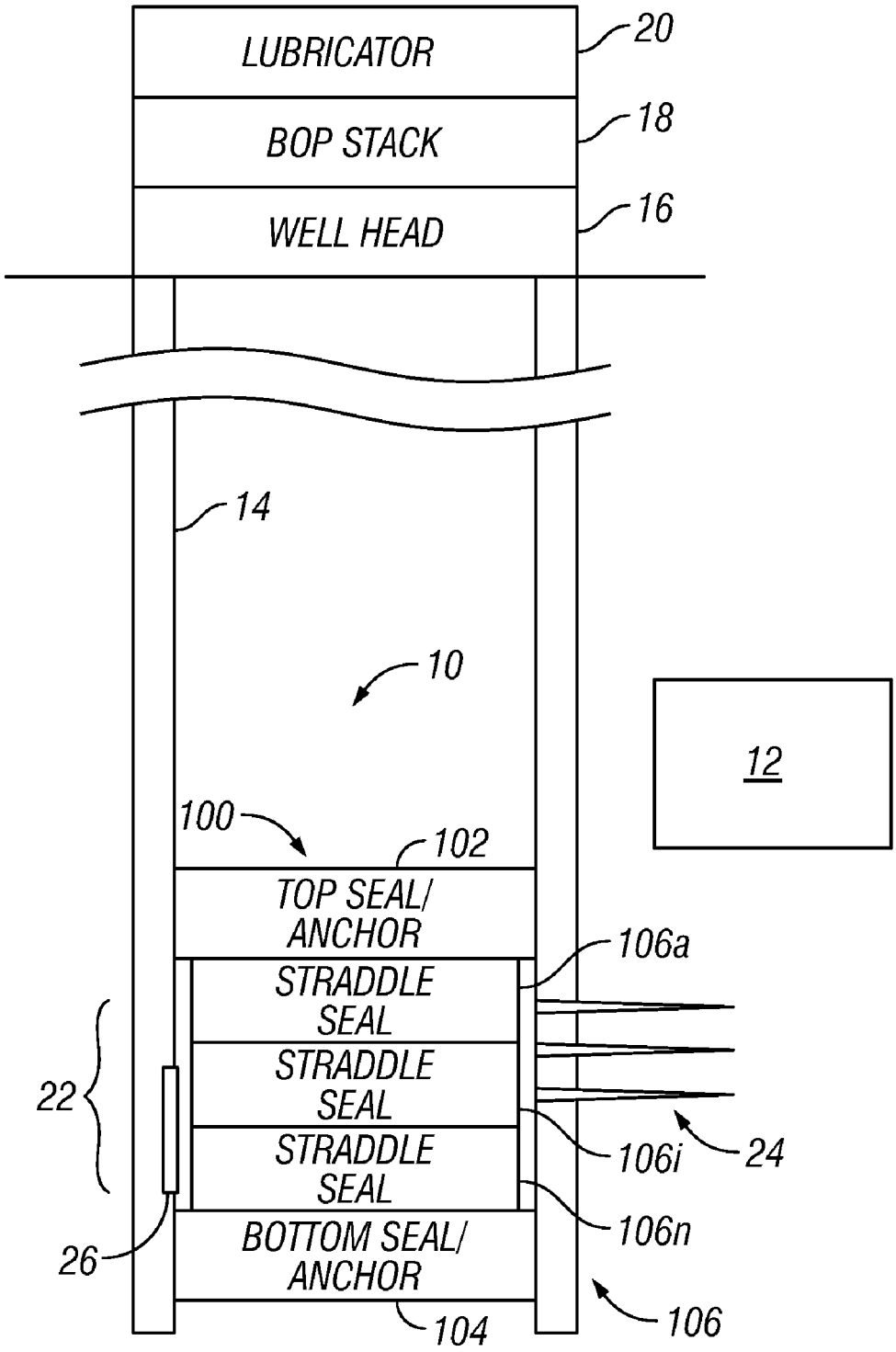
FIG. 1 schematically illustrates one embodiment of the present disclosure that is adapted to provide fluid isolation in a selected zone in a well.

The present disclosure relates to devices and methods for anchoring one or more downhole tools and/or sealing a section of a wellbore. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring now to FIG. 1, there is shown a wellbore 10 formed in a subterranean formation 12. The wellbore 10 includes a casing 14 that may cemented in place. At the surface, a well head 16 and associated equipment such as a blow-out preventer stack (BOP) 18 and lubricator 20 are positioned over the wellbore 10. As is known, production fluids such as oil and gas flow up the wellbore 10 to the surface. In some situations, a zone 22 in the wellbore 10 may require isolation to prevent wellbore fluids such as production fluids from seeping out of the wellbore 10 into the formation 12 and/or to prevent undesirable formation fluids (e.g., water) from entering the wellbore 10. This requirement can arise due to discontinuities in the casing 14 due to human made perforations 24, corrosion 26, or some other cause.

In some situations, the wellbore 10 is not under pressure and therefore tools can be conveyed into the wellbore 10 without risk that wellbore fluids will blow out at the surface.

In other situations, the well is considered "live," i.e., the wellbore 10 is filled with fluid under pressure. Thus, to prevent a well blow out, this pressurized fluid must be contained while accessing the wellbore 10. Typically, devices such as the lubricator 20 are used to control pressure in live well situations. As is known, a lubricator is a long pipe fitted to the top of a wellhead. The lubricator assembly includes a high-pressure grease-injection section and sealing elements. During use, tools are inserted into and sealed within a bore of the lubricator and the pressure in the lubricator is increased to wellbore pressure. Upon release, the tools travel into the wellbore. The length of the lubricator limits the length of the tool that can be conveyed into the live well. That is, for example, a lubricator forty feet long can only accommodate a tool less than forty feet in length. However, if the zone requiring isolation is greater than forty feet in length, then a suitable length of a conventional casing patch could not be housed within the lubricator.

Referring to FIG. 1, an illustrative embodiment of a wellbore zone isolation system 100 suitable for such applications utilizes a plurality of segments or section, each of which can be readily accommodated by conventional lubricators. Each of the segments or sections interlock or interconnect in the wellbore to form a zonal isolation barrier in the wellbore that, upon assembly, is longer that the length of the lubricator 20. In one embodiment, the configurable wellbore zone isolation system 100 adapted to provide fluid isolation in the wellbore 10 includes anchor seals 102 and 104 and a plurality of intermediate or straddle seals 106. The anchor seals 102, 104 and straddle seals 106 cooperate to form a fluid barrier across the zone 22 to prevent wellbore fluids from escaping into the formation and formation fluids from entering the wellbore 10. As will become apparent, the zone isolation system 100 can be readily configured to span upwards of several hundred or even over a thousand feet.

In one embodiment, the anchor seals 102 and 104 separately or in concert anchor the system 100 within the wellbore 10 as well as acting as a seal (i.e., a barrier against liquid or gas ingress or egress). Suitable anchoring devices for the seals 102 and 104 include packers, slips and expandable metal-to-metal seals. Suitable arrangements for preventing fluid egress or ingress include elastomeric seals, metal-to-metal seals, seals made of composite material, and other seals adapted for the wellbore environment. Merely for convenience, the anchor seal 102 will be referred to as a top anchor seal 102 and the anchor seal 104 will be referred to as a bottom anchor seal 104. It should be understood that an anchor seal can also be positioned intermediate the anchor seal 102 and the anchor seal 104 to provide added anchoring, if needed.

In one embodiment, the straddle seals 106 span the length between the anchor seals 102 and 104 and upon assembly form a sealed fluid path between the seals 102 and 104. For illustrative purposes, the straddle seals 106 are shown as including seals 106*a*, 106*i*, 106*n* wherein seal 106*a* designates the straddle seal coupling with the top anchor seal 102 and seal 106*n* designates the straddle seal coupling with the bottom anchor seal 104 Seal 106*i* represent additional seals inserted between seals 106*a* and 106*n*. Thus, in a minimal arrangement the system 100 can employ only intermediate seals 106*a* and 106*n* or in an expanded configuration include tens or hundreds of seal elements 106*i*. In one arrangement, the seals 106 are formed as interlocking elements. That is, for example, seal 106*a* is configured to mate with seal 106*i* and 106*i* is configured to mate with seal 106*n*. Appropriate locking elements such as clips, wicker teeth, threads, compression joints as well as appropriate sealing elements such as elastomeric seals or metal seals are used at the junctions between the seals 106. Some of the straddle seals 106 can be made modular or interchangeable, but this need not be necessary. The term "straddle" is intended merely to describe the seal 106 relative intermediate position between the top and bottom anchor seals 102 and 104 and is not intended to imply any particular material, structure or method of operation.

Figure 2:
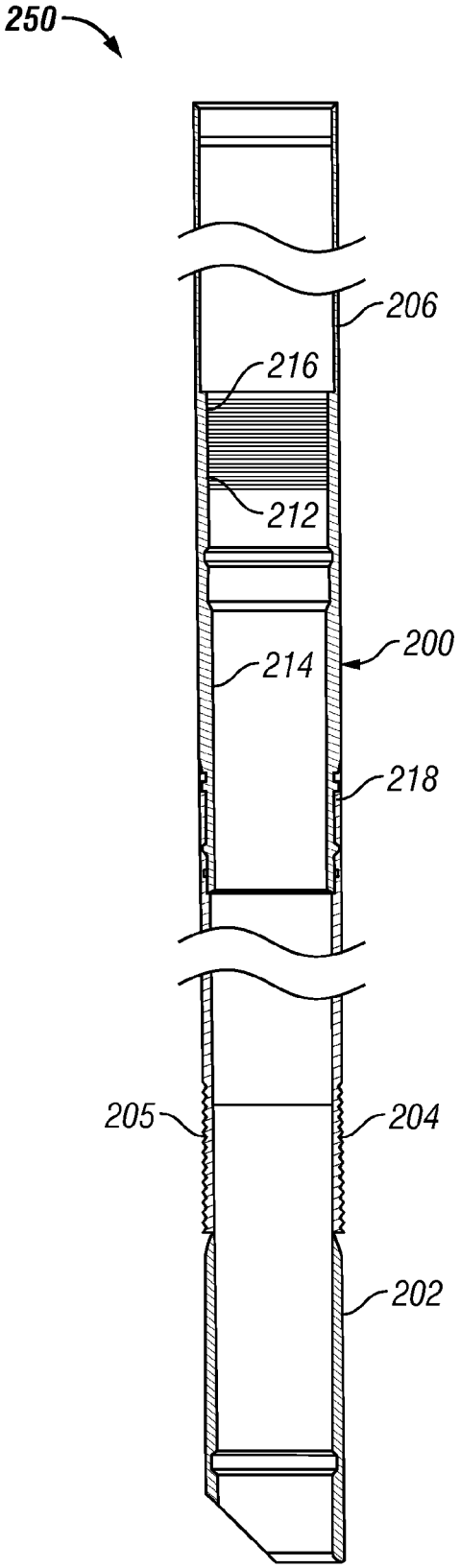
FIG. 2 schematically illustrates one embodiment of a lower anchor sealing member of the present disclosure.
Figure 3:
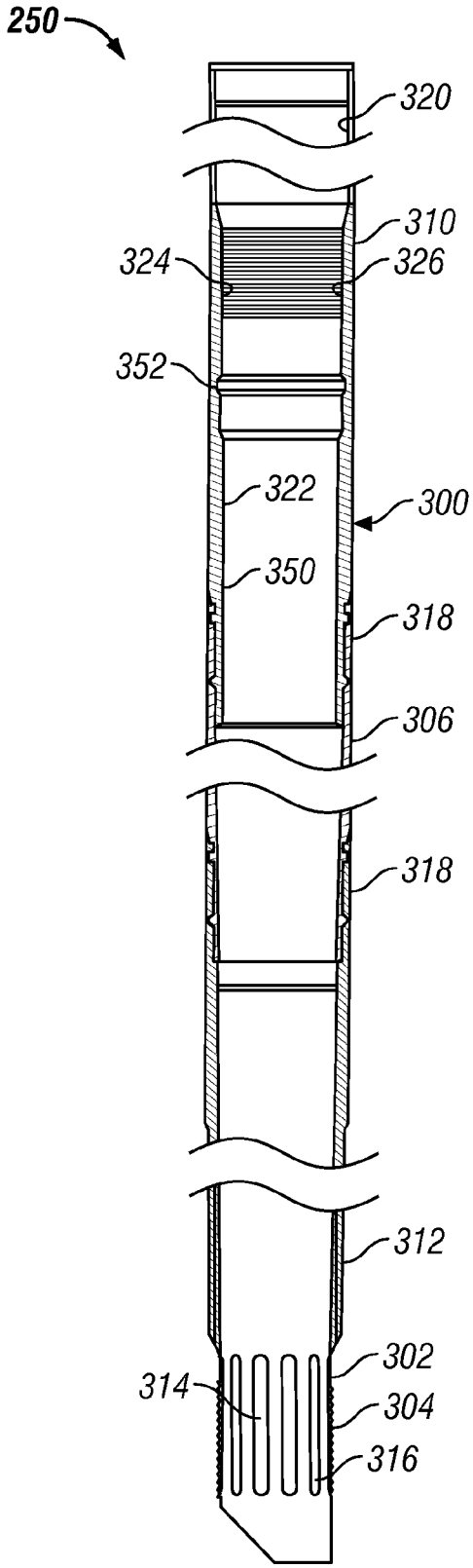
FIG. 3 schematically illustrates one embodiment of a straddle sealing member of the present disclosure.
Figure 4:
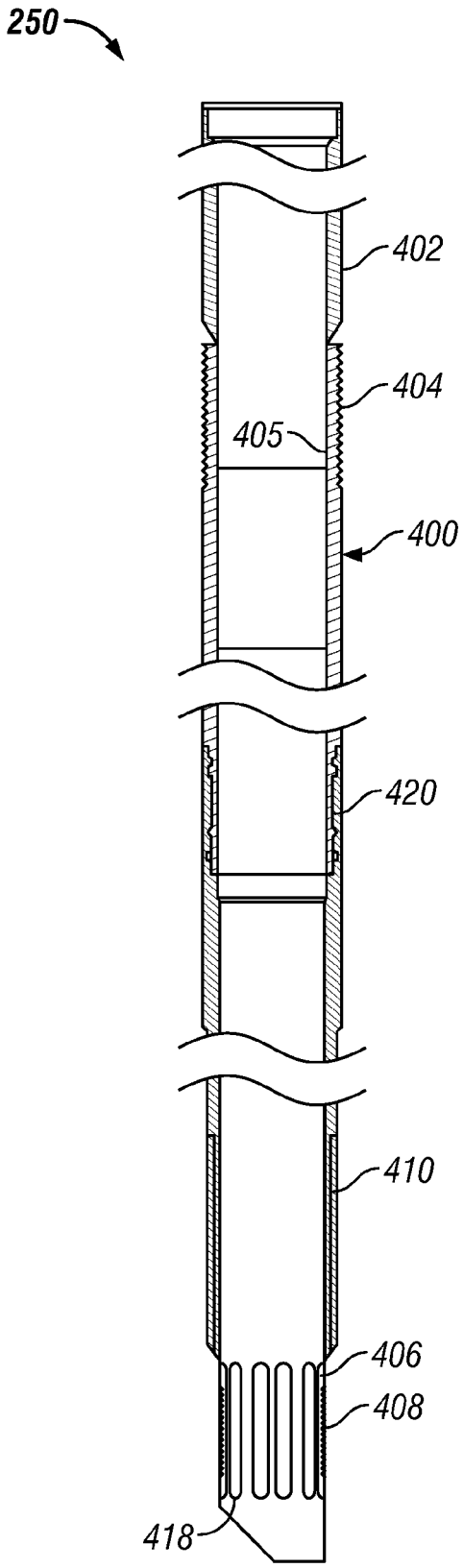
FIG. 4 schematically illustrates one embodiment of an upper anchor sealing member of the present disclosure.

Referring now to FIGS. 2-4, there is shown one embodiment of a wellbore isolation system 250 made in accordance with the present disclosure, which in one embodiment includes a lower anchor member 200, one or more straddle members 300, and an upper anchor member 300. The isolation system 250 prevents fluids such as gas or liquids from entering a selected section of a wellbore. FIG. 2 schematically illustrates one embodiment of a lower anchor member 200, FIG. 3 schematically illustrates one embodiment of an intermediate or straddle member 300, and FIG. 4 schematically illustrates one embodiment of an upper anchor member 400. Generally speaking, the lower and upper anchor members 200 and 400 fix the isolation system 250 in the wellbore and the straddle members 300 form a fluid barrier between the anchor members 200 and 400. The lower anchor member 200 and the upper anchor member 400 can employ slips, metal-to-metal seals and/or elastomeric seals that substantially fix the sealing system 250 within the wellbore and form a fluid barrier between the system 250 and an adjacent wall, such as a casing or liner wall. Suitable devices for sealing and anchoring within a tubular member are discussed in U.S. Pat. No. 6,276,690, titled Ribbed sealing element and method of use, which is hereby incorporated by reference for all purposes.

Referring to FIG. 2, an exemplary lower anchor member 200 includes a wedge member 202 that cooperates with a seal element 204 to anchor the lower anchor member 200 in the wellbore and to form a fluid seal between the lower anchor member 200 and an adjacent wall. The lower anchor member 200 also includes a seal bore portion 206 that forms an extended elongate barrier against fluid ingress into the wellbore. In one embodiment, the seal element 204 can include an expandable metal-to-metal seal and/or elastomeric seals. Exemplary seals and anchors are illustrated in co-pending and commonly owned patent application Ser. No. 11/230,240. The seal bore portion 206 includes an inner sealing surface 210 and a connection surface 212 that mate with complementary surfaces of an adjacent straddle sealing member 300. In one arrangement, the inner sealing surface 210 presents a generally polished or smooth surface that upon engaging a complementary surface forms a barrier against fluid flow into a bore 214 of the lower anchor member 200. The barrier may be formed of metal-to-metal contact and/or with seals such elastomeric seals. The connection surface 212 includes one or more recesses, protrusions or other surface features that engage complementary features on the mating surface. In one arrangement, the protrusions include a plurality of wicker-like teeth 216 permit a one-way ratcheting action described in detail below.

In some embodiments, the seal element 204 can be formed integrally with the seal bore portion 206. In other embodiments, the seal bore portion 206 is formed as a separate section that mates with the seal element 204. In one arrangement, the seal bore portion 206 and the seal element 204 are generally cylindrical members that interconnect with a threaded connection 218 or other suitable connection device. Forming the seal bore portion 206 as a separate element can be advantageous for several reasons. First, because the lower anchor member 200 can span several feet, constructing the lower anchor member 200 using multiple smaller interconnecting sections can facilitate machining, storage and handling. Second, certain applications can call for a seal element 204 with a gas-tight seal, which may require a metal-to-metal seal with elastomeric seals, whereas other applications can call for a seal element 204 with a liquid-tight seal, which may require either a metal-to-metal or elastomeric seals. Thus, the lower anchor member 200 can be constructed for a specified application by connecting an appropriately configured seal element 204 to the seal bore portion 206.

The wedge member 202 actives the seal element 204 in the following manner. During installation, the wedge member 202 is driven axially inside the seal member 204. Because the wedge member 202 has an exterior diameter that is larger than an interior bore diameter of the seal element 204, the seal element 204 is expanded radially outwards and into engagement with an interior surface of a wellbore tubular such as casing, liner, tubing, etc (not shown). In some embodiments, the interfering engagement between the wedge member 202 and the seal element 204 will maintain engagement of these two elements. In other embodiments, a locking or connecting member 205 mechanically couples the wedge member 202 and the seal element 204 during installation. The locking member 205 can include a collet finger, a spline, teeth, threads or other elements suitable for connecting the wedge member 202 with the seal element 204.

A conventional setting tool can be used to axially displace the bottom and top wedges 202, 402 (FIGS. 2 and 4). Suitable setting tools are discussed in U.S. Pat. No. 6,276,690 titled "Ribbed sealing element and method of use" and U.S. Pat. No. 3,948,321 titled "Liner and reinforcing swage for conduit in a wellbore and method and apparatus for setting same", both of which are incorporated by reference for all purposes. The setting tool can be hydraulically actuated or use pyrotechnics or some other suitable means.

Referring to FIG. 3 an exemplary straddle member 300 includes a stinger portion 302, one or more seal extensions 306, and a seal bore section 310. The stinger portion 302 co-acts with the seal bore portion 206 of the lower anchor member 200 to mechanically couple the straddle member 300 to the lower anchor member 200 and form a fluid-tight seal between these two elements. To form the fluid barrier, the stinger portion 302 includes an outer sealing surface 312 that slides into telescopic engagement with the inner sealing surface 210. In some embodiments, a surface-to-surface engagement can provide a sufficient seal whereas in other embodiments one or more seals can be interposed between the two surfaces 312 and 210. To form a mechanical connection, the stinger portion 302 includes one or more recesses, protrusions or other features that engage complementary features on a mating surface. In one arrangement, the protrusions include a plurality of wicker-like teeth 304 that engage the teeth 216 of the seal bore portion 206. The teeth 304 and teeth 216 ratchet in a manner that permits the stinger portion 302 to slide into the seal bore portion 206, but not slide out of the seal bore portion 206 upon one or more of the teeth 304 and 216 engaging and interlocking. Thus, the teeth 304 and 216 provide a one-direction locking action. In some embodiments, the teeth 304 and 216 are formed as threads such that the stinger portion 302 can be rotated out of the seal bore portion 206. Thus, such threads provide a mechanism for disassembling the straddle member 300 from a lower anchor member 200.

To facilitate engagement, the stinger portion 302 can include one or more weakened portions 314 that allow the stinger portion 302 to flex or bend while entering the seal bore portion 206. For example, one or more slots 316 formed in the stinger portion 302 can allow the stinger portion 302 to reduce in diameter or deform in some other desired manner. It should be understood that teeth 304 and 216 are merely one illustrative complementary co-acting features that provide a locking or connection arrangement between the straddle member 300 from a lower anchor member 200. In other embodiments, interlocking profiles can also be utilized to mate these components, e.g., a retractable collet having a protruding head or a threaded connection. In still other embodiments, a friction seal, a lock ring, a potting compound, and other locking arrangements can also be utilized.

The seal extension 306 is a generally tubular element that extends between the seal bore portion 310 and the stinger portion 302. In some embodiments, the seal extension 306 is formed as a one continuous tubular element. In other embodiments, the seal extension 306 is formed as a modular tubular element having a preset length. A plurality of seal extensions can be interconnected using threaded connections 318 or other suitable coupling arrangement. It will be appreciated that the axial distance separating the stinger section 302 and the seal bore portion 310 can be varied to suit a particular situation by using modular seal extensions.

The seal bore portion 310 includes an inner sealing surface 312 and a connection surface 326 that mate with complementary surfaces of an adjacent straddle sealing member 300 or of a top anchor member 400. In one arrangement, the inner sealing surface 320 presents a generally polished or smooth surface that upon engaging a complementary surface forms a barrier against fluid flow into a bore 322 of the straddle member 300. The barrier may be formed of metal-to-metal contact and/or with seals such as elastomeric, composite, or plastic seals. The connection surface 324 includes one or more recesses, protrusions or other surface features that engage complementary features on the mating surface. In one arrangement, the protrusions include a plurality of wicker-like teeth 326 permit a one-way ratcheting action previously described.

Referring to FIG. 4, an exemplary top anchor member 400 includes a wedge member 402 that cooperates with a seal element 404 to anchor the top anchor member 400 in the wellbore and to form a fluid seal between the top anchor member 400 and an adjacent wall (not shown). The top anchor member 400 also includes a stinger portion 406 that co-acts with the seal bore portion 310 of the straddle member 300 to mechanically couple the straddle member 300 to the top anchor member 400 and form a fluid-tight seal between these two elements. To form the fluid barrier, the stinger portion 406 includes an outer sealing surface 410 that slides into telescopic engagement with the inner sealing surface 320. In some embodiments, a surface-to-surface engagement can provide a sufficient seal whereas in other embodiments one or more seals can be interposed between the two surfaces 410 and 320. To form a mechanical connection, the stinger portion 406 includes one or more recesses, protrusions or other features that engage complementary features on a mating surface. In one arrangement, the protrusions include a plurality of wicker-like teeth 408 that engage the teeth 326 of the seal bore portion 310. The teeth 408 and teeth 326 provide a one-direction locking action previously described. The stinger portion 406 can also include a weakened portion 418 that allows the stinger portion 406 to deform in a manner than facilitates connection. The top anchor member 400 can also include a locking member 405 similar to the locking member 205 for connecting the wedge member 402 to the seal element 404.

As discussed in reference to the lower anchor element 400, the seal element 404 can be formed integrally with the stinger portion 406 or as a separate modular element that mates with the stinger portion 406 with a threaded connection 420 or other suitable connection device.

Figure 5:
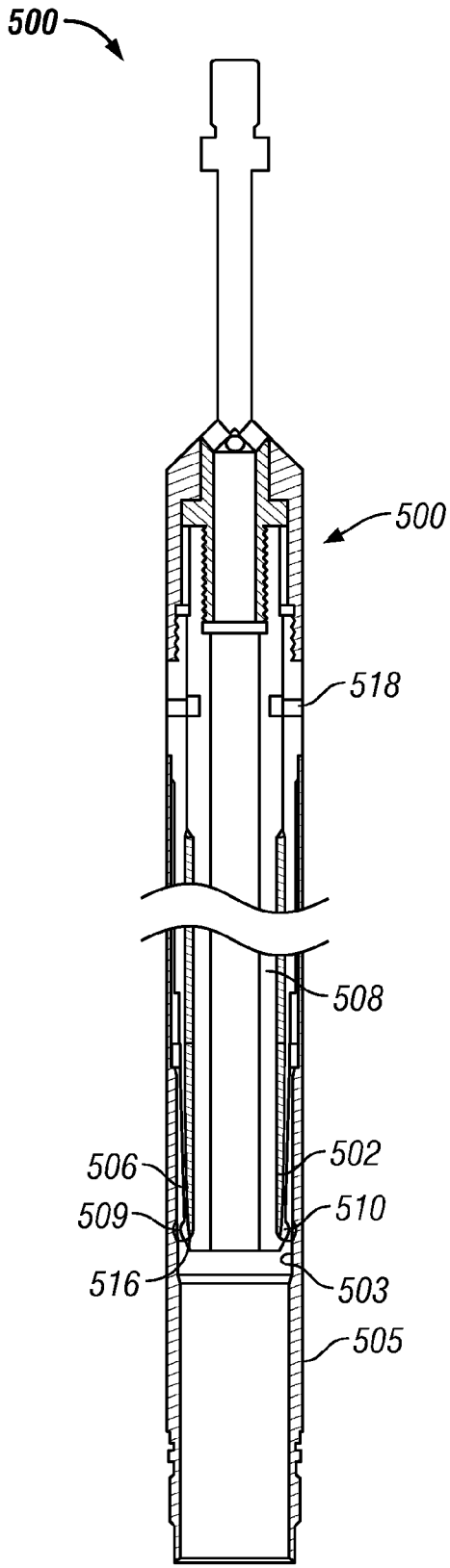
FIG. 5 schematically illustrates one embodiment of a running tool of the present disclosure.

Referring now to FIGS. 1 and 5, there is shown a running tool 500 used to deploy one or more components of the wellbore isolation device 100, 250. The running tool 500 has a connecting member 502 that engages an interior surface 503 of a selected wellbore device or tool 505 that is to be conveyed into the wellbore. In one embodiment, the connecting member 502 is coupled to the selected device at the surface and decoupled to the selected device 503 by a downward percussion on the running tool 500. The running tool 500 can be run on drill pipe, coiled tubing, slick line, wire line or any other suitable conveyance system. In one arrangement particularly suitable for a wireline or slick line application, the connecting member 502 has an outer collet 506 and an inner support rod 508. The outer collet 506 includes a plurality of radially expanding finger members 510 have a profile complementary to a profile 509 of a surface formed on the inner surface 503 of the selected wellbore tool 505. The inner support rod 508 slides axially within the collet 506, which causes the fingers 510 to move between two or more radial positions. In one arrangement, the rod 508 includes a stepped surface or shoulder 516 that urges the finger members 510 radially outward. To keep the fingers 510 in the radially outward position, a shearable or frangible member such as a shear screw 518 is used to connect and fix the rod 508 to a body of the running tool 500. The running tool 500 releases the tool 505 upon receiving a percussive force or impact of sufficient magnitude to shear the shear screw 518.

Referring now to FIGS. 3 and 5, the straddle member 300 is an exemplary tool that can be conveyed by the running tool 500. To receive the running tool 500, an inner surface 350 of the straddle member 300 includes a profile 352 complementary to the collet fingers 510. During use, the running tool 500 is inserted into the straddle member 300 and the fingers members 510 are positioned adjacent the profile 352. Next, the support rod 508 is slid or otherwise manipulated until the finger member 510 engages the profile 352. After the shear screw 518 is installed to lock the finger members 510 in the engaged position, the straddle member 300 can be prepared to run in the wellbore. In an exemplary deployment, the straddle member 300 is landed on a lower anchor member 200 or straddle member 300 already positioned in the wellbore. After engagement is established, a weight (not shown) above the tool 500 is lifted a certain distance and dropped. The applied force shears the shear screw 518, which and allows the stepped shoulder 516 of the support rod 508 to slide out from beneath the fingers 510. As the fingers 510 radially retract, the running tool 503 releases the straddle member 300.

It should be appreciated that a number of systems or methods can be used to actuate the running tool 500. For example, an electric motor can be energized to manipulate (e.g., translate or rotate) the support rod 508 or fingers 510. In other arrangements, hydraulic pressure can be applied to actuate a piston that moves the fingers 510 between the engaged and disengaged positions. In still other embodiments, the manipulation of the conveyance device (e.g., wireline, slick line, coiled tubing, drill pipe) can be used to actuate the support rod 508 or fingers 510.

Figure 7:
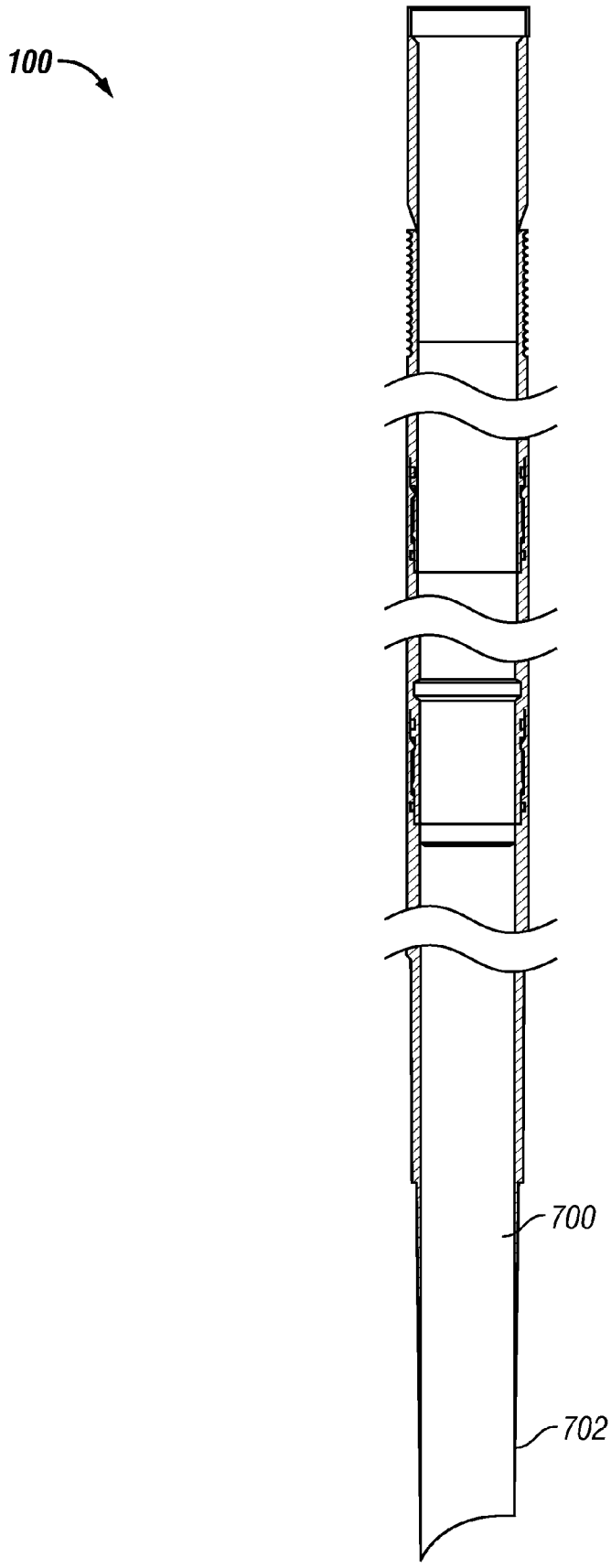
FIGS. 7 and 8 schematically illustrates one embodiment of connection arrangement made in accordance with the present disclosure.
Figure 8:
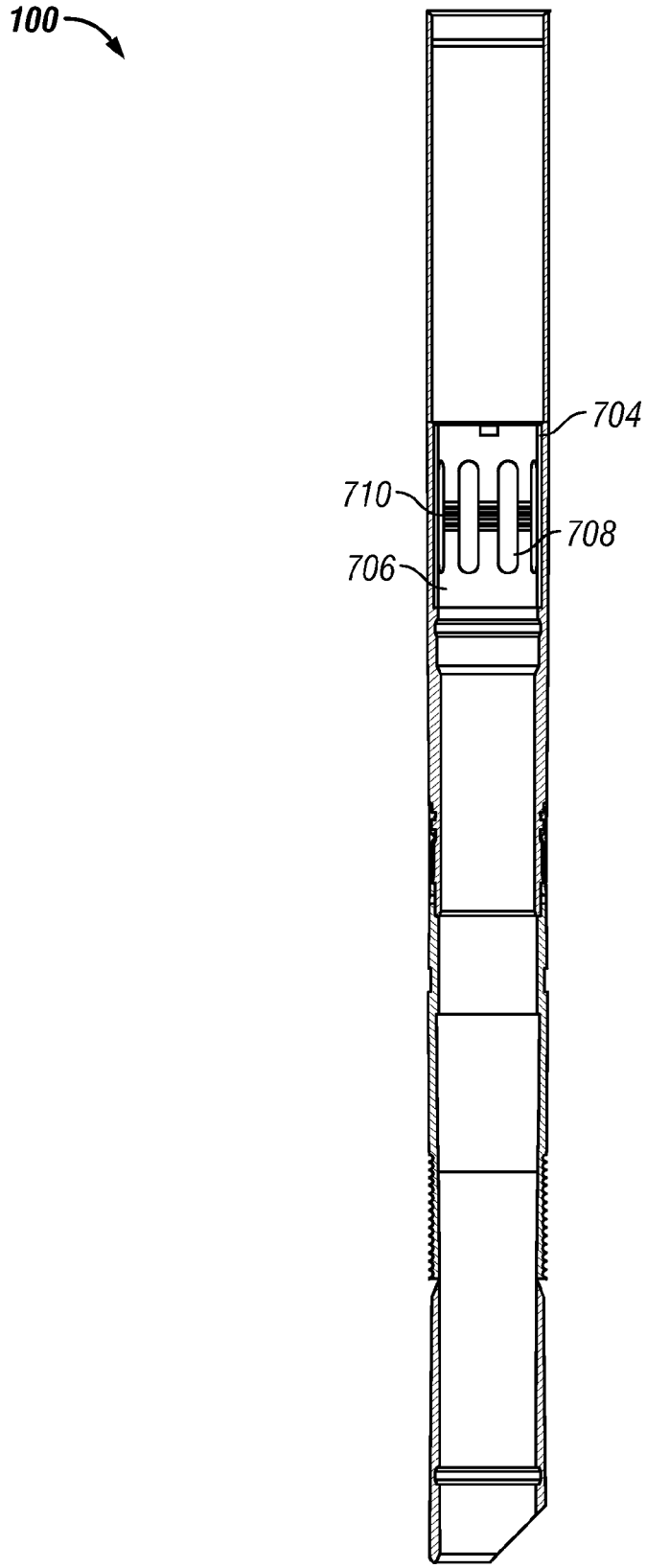

In FIGS. 3 and 4, the connection arrangement utilizes slots 316 and weakened portions 314 on the stinger portion 302. Referring now to FIGS. 7 and 8, there is shown another exemplary connection arrangement that may be utilized with the wellbore zone isolation system 100. In the variant shown in FIGS. 7 and 8, a stinger portion 700 includes teeth or wickers 702 and a seal bore portion 704 receives a sleeve 706. The sleeve 706 may be coupled or fixed to the seal bore portion 704 using a threaded connection, fastener, locking ring or other suitable mechanism. The sleeve 706 includes one or more slots 708 that allow the sleeve 706 to flex. The sleeve also includes teeth 710 that engage the teeth 702 of the stinger portion 700 when the stinger portion 700 is inserted into the seal bore portion 704. Such an arrangement may be useful, for example, to provide greater rigidity to the stinger portion 700 and/or to customize the connection for a particular application.

Figure 6:
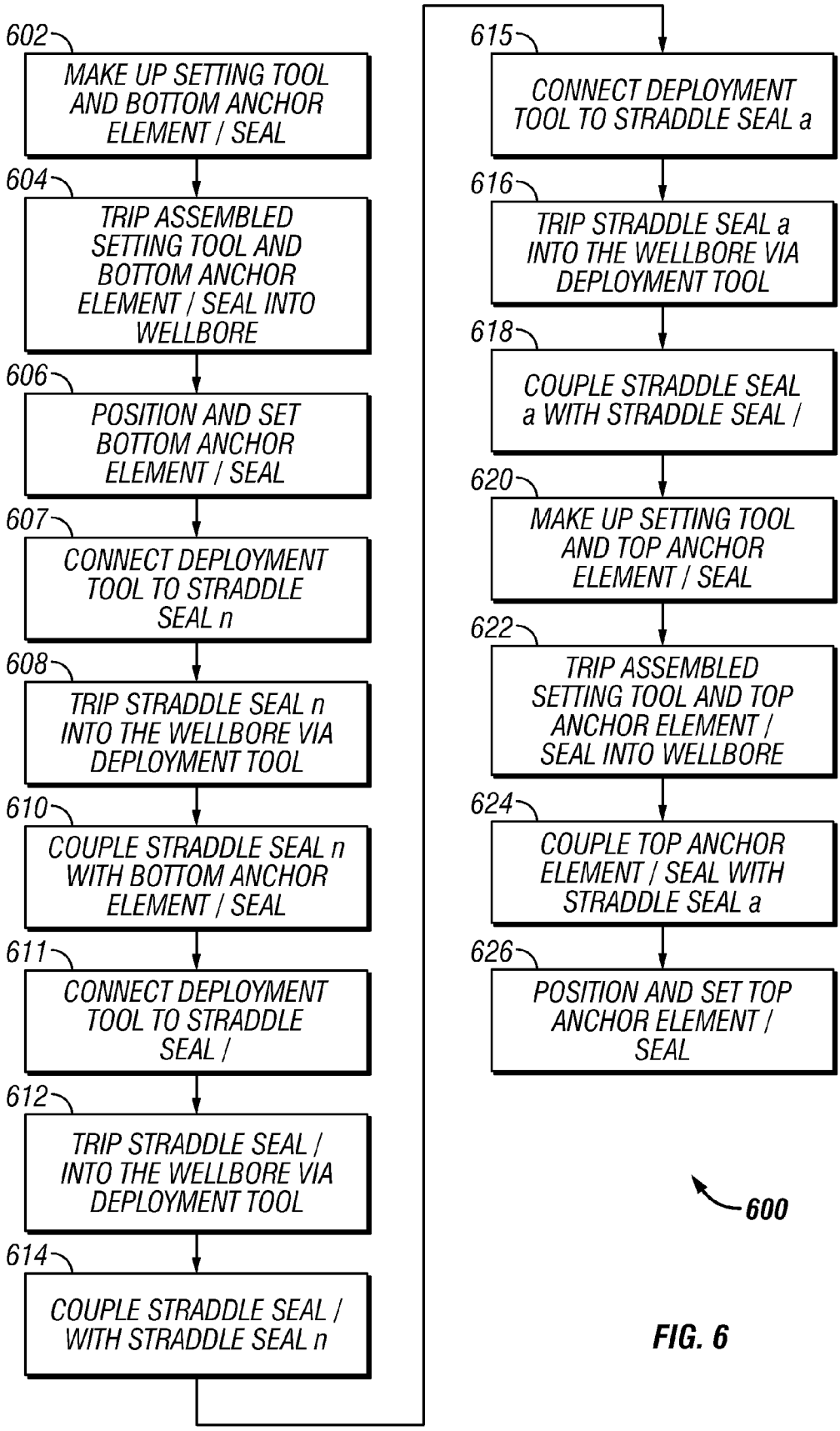
FIG. 6 illustrates in flow chart form one embodiment of a method in accordance with the present disclosure that is adapted to provide fluid isolation in a selected zone in a well.

Referring now to FIGS. 1 and 6, there is shown an exemplary method 600 for sealing a selected zone in a wellbore. The exemplary method 600 is suitable for a "live" well, i.e., wherein the formation fluid is at a pressure that cause production fluid to flow to the surface. As is known, surface equipment such as a wellhead, BOP stack, and lubricators are positioned at the surface to maintain flow and pressure control over the "live" well. Initially at step 602, a tool string for conveying the bottom anchor seal 104 is made up at the surface. The tool string can be tubing, coiled tubing, wireline or slickline. The tool string is conveyed or "tripped" into the wellbore at step 604. Upon being positioned at a selected location in the wellbore, the bottom anchor seal 104 is set at step 606. Suitable methods for setting the bottom anchor seal 104 include hydraulic pressure, pyrotechnic devices and electro-mechanical devices. At step 607, the straddle seal **106*n* is connected to a suitable deployment tool, such as that shown in FIG. 5, then at step 608, the straddle seal 106*n* is tripped into the wellbore and at step 610 the straddle seal 106*n* is coupled to the bottom anchor seal 104. At step 611 the straddle seal 106*i* is connected to the deployment tool (FIG. 5), then at step 612, the straddle seal 106*i* is tripped into the wellbore and at step 614 the straddle seal 106*i* is coupled to the straddle seal 106*n*. Steps 611 thru 614 are repeated as needed for as many straddle seals 106*i* are utilized. At step 615 the straddle seal 106*a* is connected to the deployment tool (FIG. 5). At step 616, the straddle seal 106*a* is tripped into the wellbore and at step 618 the straddle seal 106*a* is coupled to the straddle seal 106*i*. At step 620, a tool string for conveying the top anchor seal 102 is made up at the surface. At step 622 the top anchor seal is tripped into the wellbore. At step 624 the top anchor seal 102 is coupled to the straddle seal 106*a* and at step 626 the top anchor seal 102** is positioned and set.

It should be appreciated that the FIG. 6 method utilizes fewer anchoring operations than trips into the well. This can be advantageous because anchoring operations (e.g., setting an anchor using hydraulics or pyrotechnics) can be more time consuming and costly than simply tripping a tool into the well. As noted above, the straddle or intermediate seals 106 are installed without an anchoring operation. Thus, embodiments of the present disclosure can be more cost-effective to employ than systems that require a setting operation to install every or nearly every component of a sealing device. It should also be appreciated that in certain circumstances, more than two seals or anchor devices may be utilized. For instance, due to the length of a particular wellbore isolation device or due to the material properties of a casing or wellbore liner, it may be desirable or advantageous to anchor a wellbore isolation device at three or more points. Thus, for example, a wellbore isolation device made in accordance with the present disclosure can utilize a top anchor seal, a middle seal and a bottom anchor seal, all of which are separated by two or more straddle seals. Even with such a configuration, it will be appreciated that the number of anchoring operations have been minimized by utilizing intermediate or straddle seals.

Referring back to FIGS. 2 and 4, in another embodiment, isolation system 250 can include a lower anchor member 200 that connects directly to an upper anchor member 300. For example, the seal bore portion 206 of the lower member 200 can be configured to mechanically and sealingly couple to the stinger portion 406 of the upper anchor member 300. Such an arrangement can be advantageous, for example, surface equipment cannot accommodate even a relatively small zonal patch.

It should be understood that terms such as top, bottom, upper and lower do not imply any particular configuration or orientation in the wellbore. Rather, such terms are used merely to facilitate the description of aspects of embodiments of the present disclosure. One skilled in the art would understood that such terminology would not necessarily be applicable in some situations, e.g., horizontal wellbores.

The foregoing description is directed to particular embodiments of the present disclosure for the purpose of illustration and explanation. It will be apparent, however, to one skilled in the art that many modifications and changes to the embodiment set forth above are possible without departing from the scope and the spirit of the disclosure. It is intended that the following claims be interpreted to embrace all such modifications and changes.

What is claimed is:

1. A system for isolating a section of a wellbore having fluid under pressure, comprising:

(a) a wellhead positioned over the wellbore;

(b) a lubricator positioned on the wellhead, the lubricator controlling fluid pressure in the wellbore;

(c) a conveyance device conveyed into the wellbore via the lubricator and the wellhead;

(d) a first anchor adapted to sealingly engage a wellbore tubular;

(e) a second anchor spaced axially apart from the first anchor, the second anchor configured to sealingly engage a surface of the wellbore tubular; and (f) a plurality of interlocking sealing elements connecting the first anchor to the second anchor, the plurality of interlocking sealing elements having no portion sealingly engaging the wellbore tubular; and wherein the first anchor, the second anchor and the plurality of interlocking sealing elements are each configured to be separately conveyed into the wellbore with the conveyance device.

2. The system of claim 1 wherein the first anchor, the second anchor and the plurality of interlocking sealing elements are configured to confine fluid within an annular space defined by the first anchor, the second anchor and the plurality of interlocking sealing elements and a wall of the wellbore.

3. The system of claim 1 wherein the first anchor and the second anchor include one of (i) a metal-to-metal seal, and (ii) an elastomeric seal.

4. The system of claim 1 wherein each of the plurality of sealing elements includes a polished bore receptacle.

5. The system of claim 1 wherein the first anchor, the second anchor and the plurality of interlocking sealing members are configured to have a connected length that is greater than the axial length of the lubricator.

6. The system of claim 1 further comprising a first and second swage, each of which is adapted to expand the first anchor and the second anchor, respectively.

7. The system of claim 1 further comprising:

(a) a third anchor axially spaced from the second anchor; and (b) a second plurality of interlocking sealing elements connecting the second anchor to the third anchor, the second plurality of interlocking sealing elements having no portion sealingly engaging the wellbore tubular.

8. The system of claim 1 wherein the conveyance device includes a connecting member that is configured to decouple in response to a downward percussion.

9. The system of claim 1 wherein each of the plurality of interlocking elements is configured to be separately conveyed into the wellbore.

10. The system of claim 1 wherein at least two of the plurality of interlocking elements are configured to be joined together and conveyed into the wellbore.

11. A method for isolating a section of a wellbore having fluid under pressure, comprising:

conveying a first anchor into the wellbore;

activating the first anchor to sealingly engage the wellbore;

conveying a plurality of interlocking sealing elements into the wellbore, the plurality of interlocking sealing elements being tubular members that have no portion engaging the wellbore;

conveying a second anchor into the wellbore;

activating the second anchor to sealingly engage the wellbore; and connecting the first anchor to the second anchoring using the plurality of sealing elements, wherein the first anchor, second anchor and sealing elements are separately conveyed into the wellbore.

12. The method of claim 11 wherein the activating steps include driving a first and second swage into the first anchor and the second anchor, respectively.

13. The method of claim 11 further comprising controlling wellbore fluid pressure using a lubricator.

14. The method of claim 13 wherein the plurality of interlocking sealing elements, the first anchor, and the second anchor are configured to have a connected length that is greater than the axial length of the lubricator.

15. The method of claim 11 further comprising confining fluid within an annular space defined by the first anchor, the second anchor and the plurality of interlocking sealing elements.

16. The method of claim 11 further comprising conveying one of:

(i) the first anchor, (ii) the second anchor, and (iii) at least one tubular member of the plurality of interlocking sealing elements, with a connecting member.

17. The method of claim 16 further comprising activating the connecting member by applying a downward percussion to the connecting member.

18. A method for isolating a section of a wellbore having fluid under pressure, comprising:

separately conveying a first anchor, a second anchor and a plurality of interlocking sealing elements into the wellbore with a conveyance device;

activating the first anchor to sealingly engage the wellbore;

forming a straddle seal connecting the first anchor to the second anchor, the straddle seal having a plurality of sealing elements having no portion engaging the wellbore; and activating the second anchor to sealingly engage the wellbore.

19. The method of claim 18 wherein the plurality of sealing elements comprise interconnecting tubular members; and further comprising individually conveying each tubular member into the wellbore and coupling each tubular member together in a serial fashion.

20. The method of claim 18 wherein the activating steps include driving a first and second swage into the first anchor and the second anchor, respectively.

21. The method of claim 18 further comprising controlling wellbore fluid pressure using a lubricator.

* * * * *